US006369764B1

(12) United States Patent
Ishikawa

(10) Patent No.: US 6,369,764 B1
(45) **Date of Patent: *Apr. 9, 2002**

(54) EXTENDIBLE WHIP ANTENNA ASSEMBLY WITH A WHIP ANTENNA HAVING A NOTCHED STOPPER

(75) Inventor: Shigekazu Ishikawa, Sendai (JP)

(73) Assignee: Tokin Corporation, Miyagi (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/366,076

(22) Filed: Aug. 3, 1999

(30) Foreign Application Priority Data

Aug. 7, 1998 (JP) ..... 10-224089

(51) Int. Cl.[7] ..... H01Q 1/24
(52) U.S. Cl. ..... 343/702; 343/895
(58) Field of Search ..... 343/702, 725, 343/729, 895, 722, 900, 906, 791, 841, 848, 903

(56) References Cited

U.S. PATENT DOCUMENTS

| | | | | |
|---|---|---|---|---|
| 4,526,429 A | | 7/1985 | Kirkman | |
| 4,824,405 A | | 4/1989 | Derain | |
| 5,521,605 A | * | 5/1996 | Koike | 343/702 |
| 5,583,519 A | * | 12/1996 | Koike | 343/702 |
| 5,661,495 A | | 8/1997 | Saldell | |
| 5,757,325 A | | 5/1998 | Saldell | |
| 5,880,696 A | * | 3/1999 | Koleda | 343/702 |
| 5,926,138 A | * | 7/1999 | Eerikainen | 343/702 |
| 5,945,953 A | * | 8/1999 | Tsuda et al. | 343/702 |
| 5,952,974 A | * | 9/1999 | Ito et al. | 343/702 |
| 5,969,682 A | * | 10/1999 | Ito et al. | 343/702 |
| 6,011,516 A | * | 1/2000 | Minegishi et al. | 343/702 |
| 6,031,493 A | * | 2/2000 | Tsuda et al. | 343/702 |
| 6,034,639 A | * | 3/2000 | Rawlins et al. | 343/702 |
| 6,208,301 B1 | | 3/2001 | Sandgren et al. | |

FOREIGN PATENT DOCUMENTS

| | | |
|---|---|---|
| EP | 0 516 490 A2 | 12/1992 |
| GB | 2 328 084 | 2/1999 |
| WO | WO 94/28593 | 12/1994 |
| WO | WO 97/20360 | 6/1997 |

* cited by examiner

*Primary Examiner*—Don Wong
*Assistant Examiner*—Chuc D Tran
(74) *Attorney, Agent, or Firm*—Frishauf, Holtz, Goodman, Langer & Chick, P.C.

(57) ABSTRACT

An extendible whip antenna assembly (37) is provided with a combination of a helical antenna (39) mounted on an outer surface of a housing of a radio communication equipment, and a whip antenna (41). The whip antenna is movable between a retracted position in the housing and an extended position out of the housing. The extendible whip antenna assembly is further provided with a feeding arrangement for stopping the whip antenna at the extended position and feeding the whip antenna and the helical antenna. The feeding arrangement comprises a stopper (45) formed of an elastic electric conductive material and mounted on an end of the whip antenna for preventing the whip antenna from falling off from the housing, and a holder formed of an electric conductive material and electrically connected to a transceiver circuit within the housing. The holder serves to secure the helical antenna to the housing and is electrically connected to the stopper when the whip antenna is in the extended position.

7 Claims, 6 Drawing Sheets

EXTENDIBLE WHIP ANTENNA ASSEMBLY WITH A WHIP ANTENNA HAVING A NOTCHED STOPPER

BACKGROUND OF THE INVENTION

1. Field of the Invention

The present invention relates to an extendible whip antenna assembly for a mobile terminal used in mobile communication.

2. Description of the Related Art

In mobile communication, a mobile terminal or a mobile radio apparatus must constantly exchange information with base stations both in a stand-by state and during communication.

As antennas therefor, a small antenna such as a helical antenna is used in the stand-by state while a whip antenna to used during communication. These antennas are combined together to form an extendible whip antenna assembly which can be retracted into a housing of the mobile radio apparatus.

The extendible whip antenna assembly has a helical antenna which is fixed to the housing of the mobile radio apparatus via a holder serving as a feeding point, and a whip antenna which passes through the helical antenna and is slidable in the longitudinal direction.

A stopper of an electric conductor is mounted on one and of the whip antenna within the housing, and a dummy antenna portion is attached to the other end of the whip antenna. The holder is made of an electric conductor and has a flexible contact member of an electric conductor.

When extended, the stopper of the whip antenna to fitted into the flexible contact member and makes contact therewith, and the feeding point is commonly connected to the helical antenna and the whip antenna.

On the other hand, when the extendible whip antenna assembly is retracted into the housing, the dummy antenna portion is fitted into the flexible contact member and makes contact therewith so that the feeding point is connected to the helical antenna alone.

For selectively maintaining the extended position and the retracted position, the conventional extendible whip antenna assembly has at least three parts, i.e., a stopper at the lower end of the whip antenna, a holder connected to the helical antenna, and a flexible contact member.

The flexible contact member is in the holder connected to the helical antenna and, therefore, has a problem that it is difficult to adjust a friction with the whip antenna extended into the extended position.

Also, in order to place the flexible contact member within the holder, the whip element of the whip antenna must have a diameter sufficiently small as compared with a diameter of a screw for attaching the holder to the housing. In the event that the diameter of the whip element is not sufficiently small, the flexible contact member cannot be placed within the holder.

SUMMARY OF THE INVENTION

Accordingly, it is an object of the present invention to provide an extendible whip antenna assembly, wherein the whip antenna can be maintained in the extended position without using a flexible contact member within the holder connected to the helical antenna, and wherein a feeding point can be commonly connected to the whip antenna and the helical antenna, thereby reducing the number of parts for selectively maintaining the extended position and the retracted position, to thereby realize reduction in cost and weight.

It is another object of the present invention to provide an extendible whip antenna assembly, wherein it is easy to adjust the friction force applied to the whip antenna when it is extended to the extended position.

It is yet another object of the present invention to provide an extendible whip antenna assembly, wherein the whip antenna can be connected to the feeding point in parallel with the helical antenna even in the event that the diameter of the whip antenna element is not sufficiently smaller than the diameter of the screw for attaching the holder to the housing.

According to the present invention, there is provided an extendible whip antenna assembly comprising a helical antenna mounted on an outside surface of a housing of a radio communication equipment, a whip antenna slidably mounted on the housing to be movable between a retracted position where the whip antenna is retracted in the housing and an extended position where the whip antenna is projected from the helical antenna toward the outside of the housing, and feeding means for stopping the whip antenna in the extended position and for commonly feeding the whip antenna and the helical antenna. The feeding means comprises a stopper of an elastic electric conductive material and mounted on one end of the whip antenna for securing the whip antenna to the housing in an extended position, and a holder of an electric conductive material electrically connected to a transceiver circuit within the housing and fixing the helical antenna to the housing. The holder is connected to the stopper when the whip antenna is in the extended position.

DETAILED DESCRIPTION OF THE PREFERRED EMBODIMENT

Prior to description of the preferred embodiment of the present invention, a conventional extendible whip antenna assembly will be described with reference to FIGS. 1 through 3.

Figure 1:
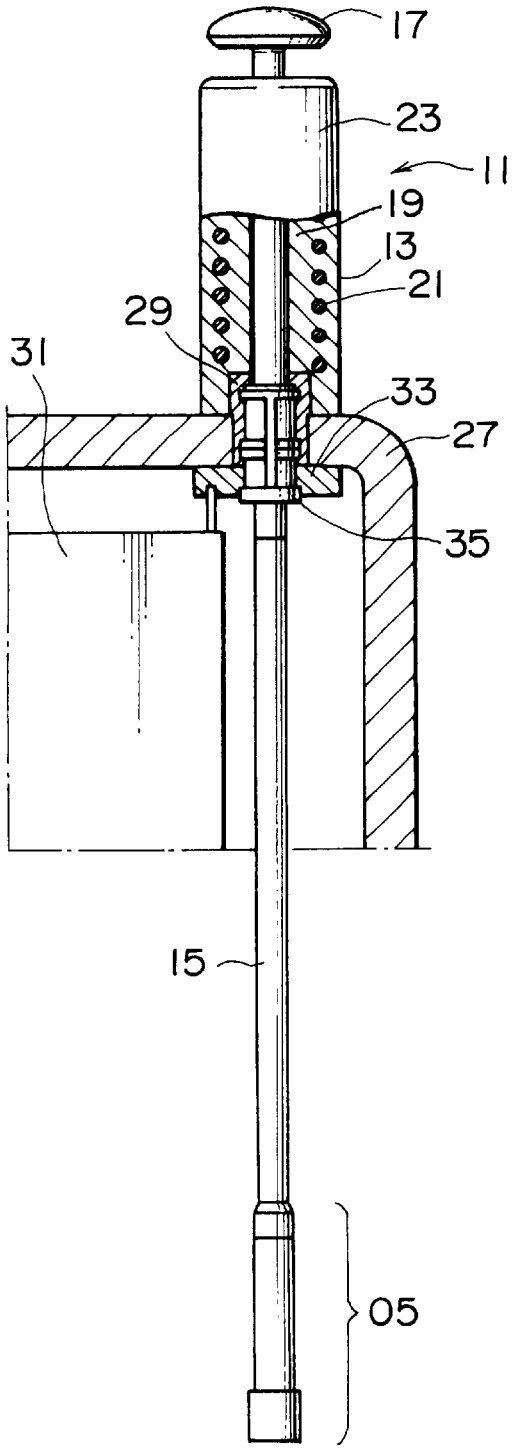
FIG. 1 PRIOR ART
FIG. 1 is a partial cross-sectional view illustrating a conventional extendible whip antenna assembly in its retracted position.

Referring to FIG. 1, the conventional extendible whip antenna assembly 11 comprises a helical antenna 13, a whip antenna 15 extending through the inside of the helical antenna 13 and slidable in the longitudinal direction, and a dummy antenna portion 17 mounted on one end of the whip antenna 15. The helical antenna 13 has a helical coil 21 wound around a hollow bobbin 19 and covered with an insulating material. Alternatively, the helical coil 21 is embedded in an insulator body comprising the bobbin 19 and the cover 23.

The whip antenna 15 comprises a whip antenna element comprising a long and thin conductive wire and an insulating cover of resin or a similar material covering the whip antenna element. A stopper 25 is formed of an electric conductive material and is mounted on one end of the whip antenna 15. A dummy antenna portion is mounted on the other end of the whip antenna element.

A holder 29 to provided to fixedly mount the helical antenna 13 to a housing 27 of a mobile radio apparatus such as a cellular telephone. The holder 29 is connected to a feeding point 33 connected to a transceiver circuit 31 and serves to feed the helical antenna 13. A flexible contact member 35 is formed of an electric conductive material and is disposed within the holder 29 and around the whip antenna 15.

Figure 2:
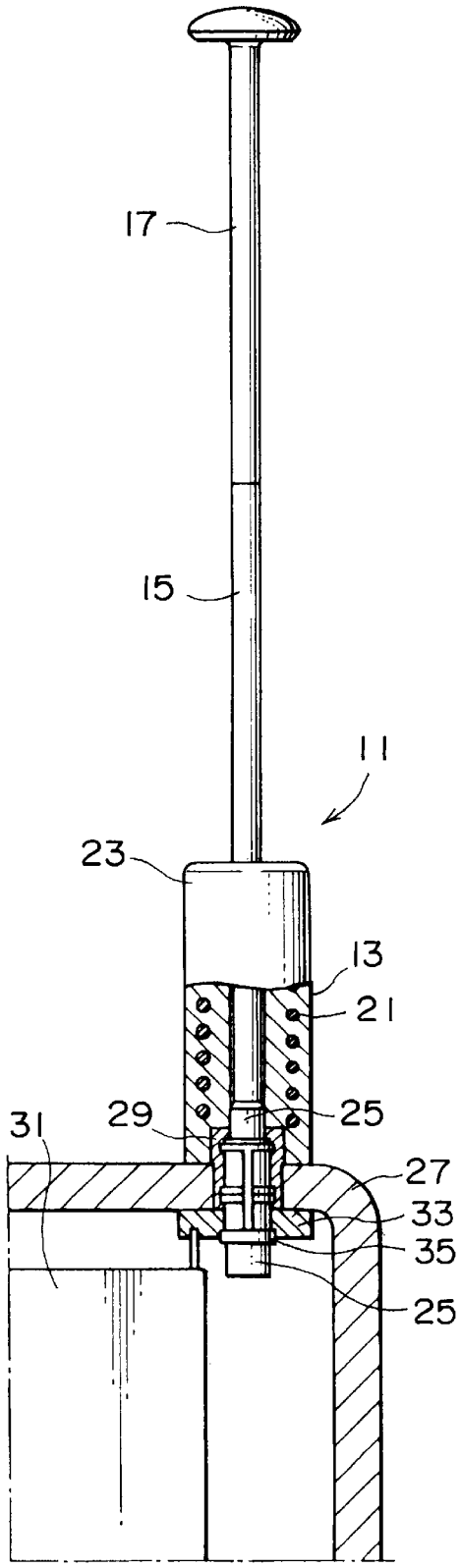
FIG. 2 PRIOR ART
FIG. 2 is a cross-sectional view illustrating the conventional extendible whip antenna assembly of FIG. 1, but in its extended position.

Referring to FIG. 2, the extendible whip antenna is extended in the extended position and the holder 29 is connected to the feeding point 33. The holder 29 is also connected to the stopper 25 of the whip antenna 15 via the flexible contact member 35. Accordingly, the whip antenna is connected to the feeding point 33 in parallel to the helical antenna 13.

In the conventional extendible whip antenna assembly, the flexible contact member 35 within the holder 29 comes into contact with the dummy antenna portion 17 on one end of the whip antenna 15 in the retracted position of the whip antenna, so that the extendible whip antenna assembly is maintained at the position.

On the other hand, when the extendible whip antenna assembly is extended, the flexible contact member 35 within the holder 29 comes into contact with the stopper 25 at the other end of the whip antenna 15, so that the whip antenna is maintained in the extended position. The stopper 25 is connected to the feeding point 33 via the flexible contact member 35 within the holder 29, 80 that the helical coil 21 and the whip antenna 15 are commonly connected to the feeding point 33.

Figure 3:
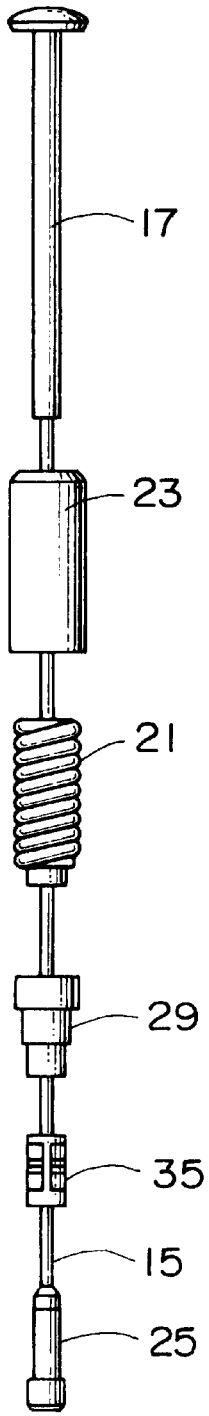
FIG. 3 PRIOR ART
FIG. 3 is a front view illustrating a semi-assembled condition of the conventional extendible whip antenna assembly shown in FIGS. 1 and 2.

Referring to FIG. 3 in addition, the change of electrical connection to the feeding point 33 between the extended position and the retracted position is carried out by cooperation of the holder 29 and the flexible contact member 35 connected to the helical coil 21 of the helical antenna 13, and the stopper 25 formed on the other end of the whip antenna 15.

Now, an embodiment of the present invention will be described with reference to FIG. 4 through FIGS. 6A and 6B.

Figure 4:
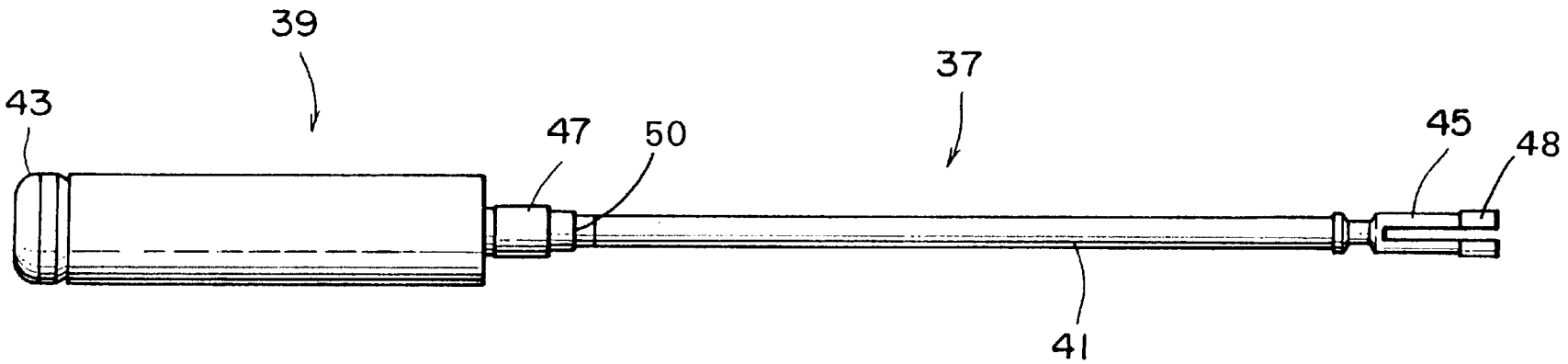
FIG. 4 is a front view illustrating an extendible whip antenna assembly according to an embodiment of the present invention, in its retracted position.

As shown in FIG. 4, the extendible whip antenna assembly 37 comprises a helical antenna 39, a whip antenna 41 extending through the inside of the helical antenna 39 and slidable in the longitudinal direction, and a dummy antenna portion 43 mounted on one end of the whip antenna 41.

The whip antenna 41 comprises a whip antenna element of a long and thin conductive wire and an insulating cover of resin or the like covering the whip antenna element. One end of this whip antenna element is connected to the dummy antenna portion 43. A stopper 45 is formed of an elastic electric conductive material such as phosphor bronze or the like, and is connected to the other end of the whip antenna element.

The helical antenna 39 is connected to a holder 47 for attaching the extendible whip antenna assembly 37 to a housing of a mobile radio apparatus, as has been described with reference to the conventional antenna assembly. The holder 47 to connected to a feeding point of a transceiver circuit in the housing.

With respect to the holder 47, a continuous body of the whip antenna 41 and the dummy antenna portion 43 is moved so that the dummy antenna portion is in the holder 47. The whip antenna 41 is retracted into the housing and the helical antenna 39 alone is located outside of the housing. In the retracted position, the helical antenna to connected to the feeding point alone.

Figure 5:
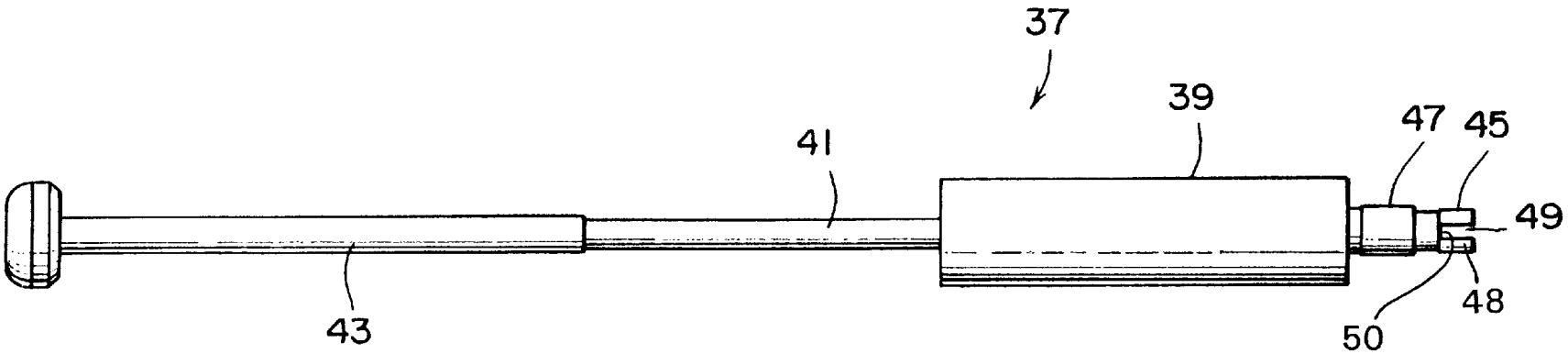
FIG. 5 is a front view illustrating the extendible whip antenna assembly shown in FIG. 4, but in its extended position.

Referring to FIG. 5, the holder 47 connected to the helical antenna 39 is brought into connection with the stopper 45 of the whip antenna 41 in the extended position of the whip antenna 41. A plurality of axial slits 49 are formed in the stopper 45 mounted on the bottom end of the whip antenna 41, so that the stopper 45 has an elasticity and is in contact with an inner surface of the holder 47. Therefore, the stopper 45 is connected to the feeding point in parallel to the helical antenna 39.

Figures 6A, 6B:
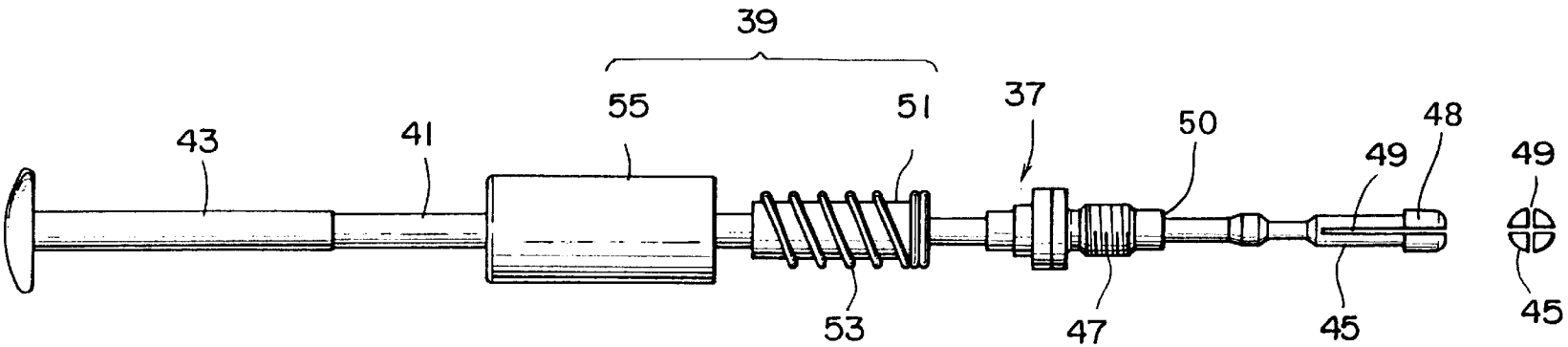
FIG. 6A is a front view illustrating a semi-assembled condition of the extendible whip antenna assembly shown in FIGS. 4 and 5.
FIG. 6B is an end view of a stopper shown in FIG. 6A.

As shown in FIG. 6A, the helical antenna 39 comprises a helical coil 53 wound around a cylindrical coil bobbin 51 formed of an insulating material, and a cylindrical helical antenna cover 55 for covering the periphery thereof.

Also, as shown in FIG. 6B, the axial slits 49 are formed to have a arose shape in a cross section.

The whip antenna element of the whip antenna 41 is fixed with the stopper 45 at the portion of the one end of the stopper 45 where the slits 49 are not formed. The stopper 45 has elasticity at the portion formed with the slits 49 and is elastically pressed onto the inside surface of the holder 47. Therefore, the stopper 45 is brought into reliable connection with the holder 47.

As shown in FIGS. 4, 5 and 6A, the stopper 45 is provided with lateral projection 48 which abut against an external abutment end 50 of the holder 47 when the whip antenna 41 is in the extended position.

According to this invention, in the extendible whip antenna assembly comprising a combination of the helical antenna and the whip antenna retractable into and extendible from the housing, the whip antenna is maintained in the extended position by the stopper having the axial slits to thereby exhibit elasticity without using a flexible contact member within a holder. Accordingly, the helical antenna and the whip antenna can be connected to the feeding point in parallel to each other in the extended position. Thus, the number of parts can be reduced, thereby reducing the cost and the weight.

Also, the extendible whip antenna assembly according to the present invention is capable of adjusting the friction force applied to the whip antenna when extended to the extended position, by means of axial slits and by the use of an elastic material such as phosphorous bronze for the stopper. The weight of the stopper is also reduced as compared with conventional stoppers, since the axial slits are provided therein.

Furthermore, in the extendible whip antenna assembly according to the present invention, the length of the antenna element can be reduced because the antenna element is secured to the upper portion of the stopper, as compared with the conventional arrangement wherein the whip antenna element is required to have a length reaching the lowermost portion of the stopper.

Moreover, in the extendible whip antenna assembly according to the present invention, the diameter of the whip antenna element need not be sufficiently smaller than the diameter of the screw for attaching the holder to the housing, because the stopper is formed with the axial slits and thereby has elasticity.

What is claimed is:

1. An extendible whip antenna assembly comprising:

a helical antenna adapted to be mounted on an outside surface of a housing;

a whip antenna extending through an inside of the helical antenna, said whip antenna being slidably movable between (i) a retracted position in which the whip antenna is retracted into the housing, and (ii) an extended position in which the whip antenna projects from the helical antenna beyond the outside surface of the housing;

a holder made of an electrically conductive material, said holder being adapted to be electrically connected to a transceiver circuit within the housing and to fix the helical antenna to the housing; and a stopper made of an elastic electrically conductive material, said stopper being coupled to a proximal end of the whip antenna and said stopper including lateral projections for abutting against an external abutment end of the holder when the whip antenna is in the extended position so as to secure the whip antenna to the housing when the whip antenna is in the extended position;

wherein the stopper comprises at least one axial slit extending from a first end of the stopper.

2. The extendible whip antenna assembly according to claim 1, wherein the stopper is coupled to the proximal end of the whip antenna at a second end of the stopper.

3. The extendible whip antenna assembly according to claim 1, wherein the stopper comprises two axial slits extending from the first end of the stopper, and the two axial slits intersect each other so as to form a substantially cross shaped cross section when viewed from the first end of the stopper.

4. The extendible whip antenna assembly according to claim 1, further comprising a dummy antenna portion coupled to a distal end of the whip antenna, said dummy antenna being adapted to enable the whip antenna to be pulled out from the retracted position to the extended position, and said dummy antenna being abutted against the holder to block inward feeding of the whip antenna when the whip antenna is in the retracted position.

5. The extendible whip antenna assembly according to claim 1, wherein the lateral projections are provided at the first end of the stopper.

6. The extendible whip antenna assembly according to claim 5, wherein the holder comprises an proximal end and a distal end, and the external abutment end is provided at the proximal end of the holder.

7. The extendible whip antenna assembly according to claim 6, wherein the lateral projections at the first end of the stopper abut against the external abutment end at the proximal end of the holder when the whip antenna is in the extended position.

* * * * *